US005703432A

United States Patent [19]

Jeong

[11] Patent Number: 5,703,432

[45] Date of Patent: Dec. 30, 1997

[54] SCREEN STRUCTURE OF A CATHODE-RAY TUBE

[75] Inventor: Bong-kwon Jeong, Kyungsangnam-do, Rep. of Korea

[73] Assignee: Samsung Display Devices Co., Ltd., Kyungki-do, Rep. of Korea

[21] Appl. No.: 645,276

[22] Filed: May 13, 1996

[30] Foreign Application Priority Data

Jun. 21, 1995 [KR] Rep. of Korea ..... 95-14157

[51] Int. Cl.[6] ..... H01J 1/62

[52] U.S. Cl. ..... 313/461; 313/112; 313/466; 313/467

[58] Field of Search ..... 313/461, 463, 313/466, 467, 470, 473, 112; 359/885, 891, 893, 609, 614; 348/835

[56] References Cited

U.S. PATENT DOCUMENTS

| | | | |
|---|---|---|---|
| 3,087,085 | 4/1963 | Turner | 313/463 X |
| 3,210,585 | 10/1965 | McNaney | 313/463 |
| 4,301,388 | 11/1981 | Mason | 313/461 X |
| 5,559,397 | 9/1996 | Tsuruoka et al. | 313/112 X |

*Primary Examiner*—Ashok Patel

*Attorney, Agent, or Firm*—Christie, Parker & Hale, LLP

[57] ABSTRACT

A screen structure of a cathode-ray tube includes color filters of three R, G and B colors arranged individually on the inside of the panel, black matrixes between each color filter, a complex phosphor which mixes phosphors of the R, G and B three primary colors in equal proportion on the front side, black matrixes and color filters being spread on the front side, to maintain the most suitable repeatability of images, namely the most suitable color purity and brightness character, demonstrating an easy formation of the screen.

3 Claims, 1 Drawing Sheet

SCREEN STRUCTURE OF A CATHODE-RAY TUBE

BACKGROUND

The present invention relates to a screen structure of a cathode-ray tube.

In general, the color cathode-ray the includes a bulb having a panel, a funnel, and a neck all of which are combined in a body, and the inner face of the panel is formed with a screen which includes phosphors of the three primary colors R, G and B. Also, a shadow mask having a color-sorting function is disposed in a fixed distance from the screen and it is set up with the panel.

Here, the screen includes R, G and B phosphors which are formed with designated patterns respectively, black matrixes which are formed for avoiding the color overlay between the phosphors, a metal back which double the brightness by forming a reflection surface on the phosphor screen.

The above color cathode-ray tube embodies regular images as follows: the three R, G and B electron beams are emitted from an electron gun which is inserted in the neck; the electron beams are deflected in every direction by a deflection yoke; they continually penetrate through a hole of the shadow mask thereby being concentrated upon one point; they land at R, G and B phosphors which are formed on the inside of the panel.

In this case, the panel is generally composed of a clear glass. However, the clear glass has the problem of color transparency which occurs by external lights. To solve the problem, a tinted panel glass has been used for improving contrast of a cathode-ray tube of the prior art.

However, the tinted panel has the problem of decreasing the transmission factor of light thereby decreasing the brightness of a screen.

The prior cathode-ray tube inserts color filters in the screen surface, and it forms the panel into the clear glass in order to solve this problem and improve brightness. The structure of a prior cathode-ray tube is illustrated in FIG. 3.

As can be seen in the drawings, the cathode-ray tube comprises a panel 1, and red, green, and blue color filters, 3R, 3G, and 3B disposed on the interface of the panel 1. The color filters 3R, 3G, and 3B are separated by a black matrix 5. That is, the black matrixes 5 are disposed between the color filters 3R, 3G, and 3B. In addition, red, green, and blue phosphors 7R, 7G, and 7B are disposed on the corresponding red, green, and blue color filters 3R, 3G, and 3B. The red, green, and blue color filters enhance the color purity.

In this case, the color filters 3R, 3G, and 3B improve color purity with phosphors 7R, &G, and 7B. Also, the panel 1 realizes an improvement in brightness by adoption of the clear glass.

However, the cathode-ray tube, by the utilization of the clear glass, makes the manufacturing process complex and the costs of installation very high.

The prior screen forming process in which both black matrixes and three phosphor slurries are applied, and the manufacturing processes of exposure, development, dry, and the like are undertaken, is a very complex process.

Furthermore, it is common knowledge that the prior cathode-ray tube is made even more complex in the manufacturing process where color filters of three R, G and B colors must be added.

Also, the prior method uses equipment for exposure and removal of dust to each phosphor, therefore bringing about increased production costs.

SUMMARY

The present invention is proposed to solve general problems of the prior art. It is an object of the present invention to provide a screen structure of a cathode-ray tube which can maintain the most suitable repeatability of images, namely, the most suitable color purity and brightness characteristics, realize the formation of the screen, and decrease installation and production costs.

To achieve the above objectives, the present cathode-ray tube includes the screen structure which arranges three R, G and B color filters on the inside of the panel, and forms black matrixes between each of the color filters.

Here, the present invention forms a complex phosphor which mixes at least two phosphors of the R, G and B three primary colors in equal proportion on the front side, the front side having black matrixes and color filters spread on it.

Accordingly, the present invention can simplify the manufacturing processes which forms, individually, three R, G and B phosphors, the amount of manufacturing equipment used in the process, and also bring down costs.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

A preferred embodiment of the present invention will now be described in detail with reference to the accompanying drawings.

Figure 1:
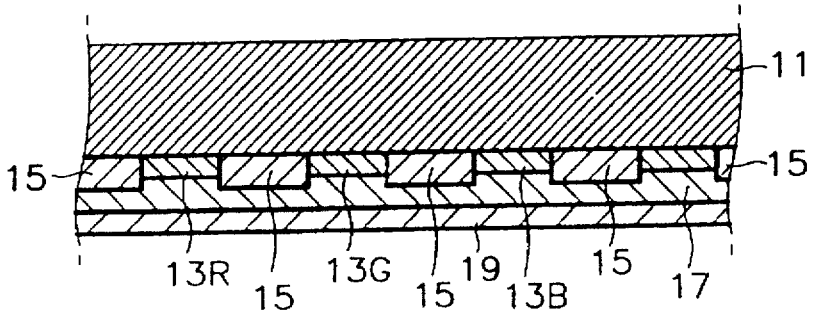
FIG. 1 is a cross-sectional view illustrating a screen structure of a cathode-ray tube in accordance with a first preferred embodiment of the present invention.
Figure 2:
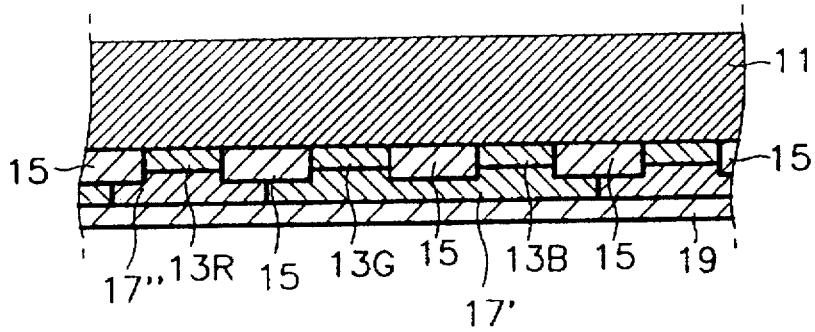
FIG. 2 is a cross-sectional view illustrating a screen structure of a cathode-ray tube in accordance with a second preferred embodiment of the present invention.

FIG. 1 is a cross-sectional view illustrating a screen structure of a cathode-ray tube in accordance with a first preferred embodiment of the present invention and it illustrates a part which cuts the panel to the direction of tube axis.

As shown in the drawing, the screen structure includes color filters 13R, 13G, and 13B of the R, G and B three primary colors, which are formed distinctly in the regular pattern in the inside of the panel, and black matrixes which are formed for preventing purity drift between the color filters 13R, 13G and 13B.

In this case, the panel 11 is included by adoption of clear glass. One knows that this clear glass obtains better brightness than the prior tint glass (generally, less than a 57% transmission factor of light) because it is more than an 86% transmission factor of light.

Also, in the prior art, the above color filters 13R, 13G and 13B can improve the color purity of images because each R, G and B electron beam makes light emitting efficiency of irradiated phosphors higher.

Here, the screen structure of the present invention is made by formation of a complex phosphor 17 which phosphors of the R, G and B three, primary colors mix in the whole inside of the panel 1 on which black matrixes 15 and color filters 13R, 13G and 13B are spread.

The complex phosphor 17 is what is called a white phosphor, and it can be realized by a mixture of phosphors of R, G and B primary colors in equal proportion.

According to the invention, the formation of the screen can be completed by one slurry spread, exposure, development and drying without complication of the manufacturing process that each one forms R, G and B phosphors.

For this reason, the invention demonstrates the simplification of the manufacturing process, unlike the prior art, and achieves a lower installation fee and production costs because there is no longer the necessity to have repeated dust removal and exposure steps.

According to the screen structure of the preferred embodiment, the color cathode-ray tube embodies regular images as follows: the three R, G and B electron beams emitted from an electron gun are inserted in the neck; the electron beams are deflected in every direction by a deflection yoke; they continually penetrate a hole of the shadow mask, being concentrated upon one point; they land at R, G and B phosphors which are formed on the inside of the panel.

At this time, the R, G and B electron beams emitted from the electron gun radiate each of the proper phosphors, the light on the whole surface of the screen through color filters 13R, 13G and 13B.

On the other hand, No. 19 describes a metal back in the drawings. As described above, this metal back doubles the brightness by forming a reflection surface.

Figure 3:
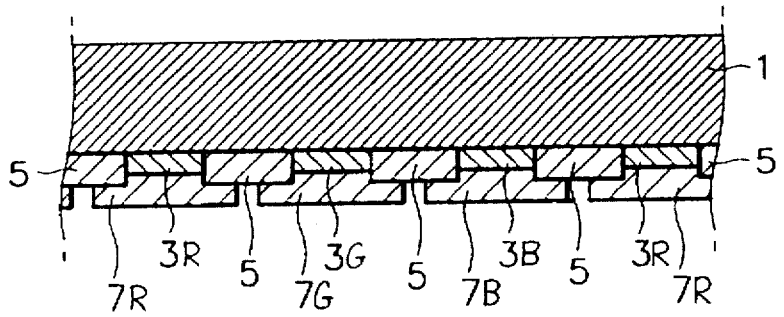
FIG. 3 (Prior Art)
FIG. 3 is a cross-sectional view illustrating a screen structure of a cathode-ray tube in accordance with a preferred embodiment of the prior art.

In addition, referring to FIG. 3, there is crosssectionally illustrated a screen structure of a cathode-ray tube in accordance with a second preferred embodiment of the present invention. It is different from the first preferred embodiment of the present invention in that it may be a complex phosphor 17" constituted of only G, B phosphors except R phosphor and a phosphor 17' constituted of R phosphor among the R, G, B three phosphors. As, illustrated in the second embodiment of the present invention, the complex phosphor is constituted of only G and B phosphors, however, it is not limited in that and may be constituted of R,G or R,B phosphors.

As described above, the screen structure of a cathode-ray tube can maintain the most suitable repeatability of images, namely the most suitable color purity and brightness because it includes clear glass and color filters.

Also, the invention can achieve an easy manufacturing process and decrease installation fees and production costs by forming the complex phosphor which mixes phosphors of the R, G and B three primary colors.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A screen structure for a cathode-ray tube comprising:

red, green, and blue color filters arranged on the screen;

black matrixes disposed between the color filters; and a complex phosphor comprising at least two phosphors selected from a group consisting of red, green, and blue phosphors in substantially equal proportion spread on the color filters and the black matrixes.

2. The screen structure for a cathode-ray tube according to claim 1 wherein the complex phosphor comprises red, green, and blue phosphors.

3. The screen structure for a cathode-ray tube according to claim 1 wherein the complex phosphor comprises green and blue phosphors.

* * * * *